United States Patent [19]

Beghin

[11] 4,074,750

[45] Feb. 21, 1978

[54] INTERNALLY COOLED ROLL

[75] Inventor: Marcel Beghin, Lille, France

[73] Assignee: Fives-Cail Babcock, Paris, France

[21] Appl. No.: 670,128

[22] Filed: Mar. 25, 1976

[30] Foreign Application Priority Data

Mar. 28, 1975 France ..... 75 09836

[51] Int. Cl.[2] ..... F28F 5/02

[52] U.S. Cl. ..... 165/89; 29/110

[58] Field of Search ..... 29/125, 126, 110; 165/87-92

[56] References Cited

U.S. PATENT DOCUMENTS

| | | | |
|---|---|---|---|
| 1,675,274 | 6/1928 | Miller | 165/89 |
| 2,936,158 | 5/1960 | Ramundo | 165/89 |
| 3,100,631 | 8/1963 | Schmidt | 165/89 |
| 3,887,250 | 6/1975 | Fleissner | 165/89 X |

*Primary Examiner*—Charles J. Myhre
*Assistant Examiner*—Theophil W. Streule, Jr.
*Attorney, Agent, or Firm*—Kurt Kelman

[57] ABSTRACT

An internally cooled roll comprises a cylindrical body having two coaxial trunnions. A longitudinal conduit extends in the interior of the body in the direction of its axis for circulating a cooling fluid therethrough, and a tubular conduit is disposed in the longitudinal conduit. The cooling fluid is supplied to one of the conduits and removed from the other conduit, either fluid supply or removal being obtained by a fluid collector element connected to the tubular conduit and passing through one of the trunnions.

9 Claims, 8 Drawing Figures

INTERNALLY COOLED ROLL

The present invention relates to improvements in internally cooled rolls, particularly rolls used in continuous metal casting installations wherein a freshly molded metal strip or ingot is removed from the mold through a roll-rack comprising a series of cooled guide rolls.

Continuous metal casting installations of this type are well known, as shown, for instance, in U.S. Pat. No. 3,763,923, dated Oct. 9, 1973. The cooling rolls in such installations are subjected to considerable thermal strains because of the very high temperatures of the castings leaving the mold and passing into contact with the guide rolls. It has, therefore, been found advantageous to cool the rolls internally and or externally, internal cooling usually being preferred.

Internally cooled rolls are well known. Known rolls of this type comprise a central core surrounded by a cylindrical envelope, with cooling channels worked between the core and the envelope. Producing these channels involves careful machining of the core or the envelope, as well as of at least one of the trunnions for the roll which is integral with the core.

It is the primary object of this invention to overcome these manufacturing disadvantages and to provide an internally cooled roll of simple structure and which can be manufactured economically.

This and other objects are accomplished in accordance with the invention with an internally cooled roll which comprises a cylindrical body and two coaxial trunnions, the body defining in the interior thereof a longitudinal conduit extending in the direction of the axis of the cylindrical body for circulating a cooling fluid therethrough. A tubular conduit is disposed in the longitudinal conduit. Means for supplying the cooling fluid to one of the conduits and removing the fluid from the other conduit includes a fluid collector element connected to the tubular conduit and passing through one of the trunnions.

According to the present invention an internally cooled roll is manufactured by forming a cylindrical body and a coaxial trunnion at one end thereof, and in the interior thereof a longitudinal conduit extending in the direction of the axis of the body, disposing a tubular conduit in the longitudinal conduit, connecting a cooling fluid collector element to the tubular conduit, the collector element projecting from the other end of the cylindrical body, and affixing another coaxial trunnion to the other end of the cylindrical body, the other trunnion having a passage surrounding the projecting collector element. The cylindrical body and one trunnion with the longitudinal conduit may be formed by casting or machining from a forged shape.

The above and other objects, advantages and features of this invention will become more apparent from the following detailed description of certain now preferred embodiments thereof, taken in conjunction with the accompanying drawing wherein FIG. 1 is a longitudinal axial section of one embodiment of an internally cooled roll according to the invention;

Figure 1:
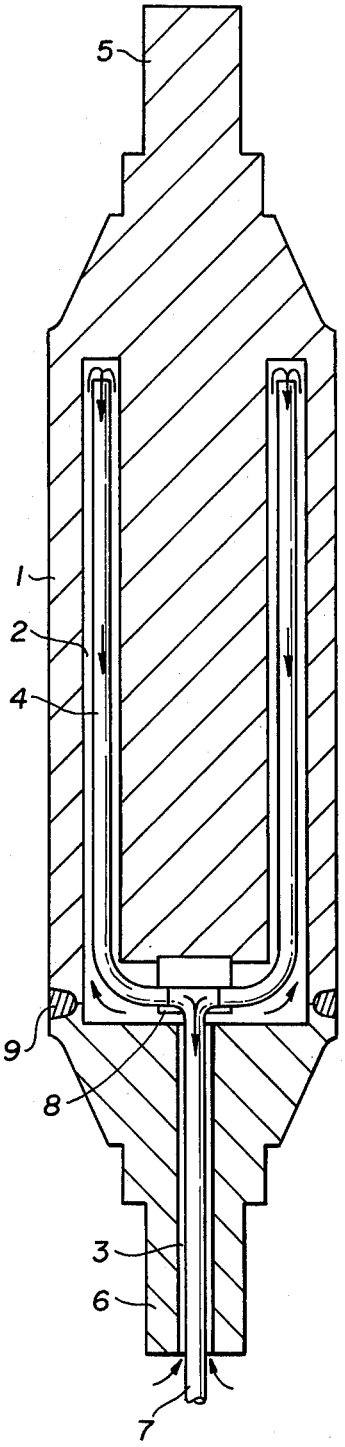
Figure 2:
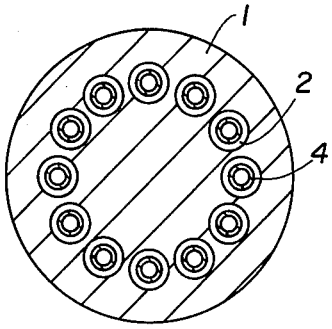
FIG. 2 shows a transverse section of the roll of FIG. 1.

Referring now to the drawing, wherein like reference numerals designate like parts operating in a like manner in all figures, FIGS. 1 and 2 show an internally cooled roll comprised of cylindrical body 1 having two coaxial trunnions 5 and 6 at respective ends thereof. Cylindrical body 1 and trunnion 5 are constituted by an integral piece while trunnion 6 is affixed to body 1 by weld 9. Trunnion 6 defines a coaxial fluid passage 3 threre-through, which is produced by machining or by casting the trunnion with this passage.

In this embodiment, cylindrical body 1 defines a plurality of longitudinal conduits 2 which are cylindrical and distributed evenly about the axis of the body in an annular array, as best seen in FIG. 2. Body 1 with its longitudinal conduits may also be cast or it may be obtained by machining a forged piece of metal. A tubular conduit 4 is disposed in each longitudinal conduit 2 and is seated therein over most of its length. As shown in FIG. 1, all the tubular conduits are connected to fluid collector element 7. After the assembly of tubular conduits 4 and fluid collector element 7 have been placed in position in the cylindrical body, they are suitably affixed to support 8 which is integral with body 1 and disposed axially therein. Trunnion 6 is now put into place, with the fluid collector element passing through, and surrounded by, passage 3 in the trunnion, and the trunnion is welded to body 1.

Passage 3 and element 7 constitute means for supplying a cooling fluid to one of the conduits and removing the fluid from the other conduit, the arrows in FIG. 1 indicating that the fluid is supplied through passage 3 and removed through element 7 after it has been circulated through longitudinal conduits 2 and tubular conduits 4. Obviously, the direction of circulation may be reversed, the cooling water being introduced through element 7 and being withdrawn through annular passage 3. Water pumps (not shown) entrain the water to produce the desired circulation through the interior of the roll.

Figure 3:
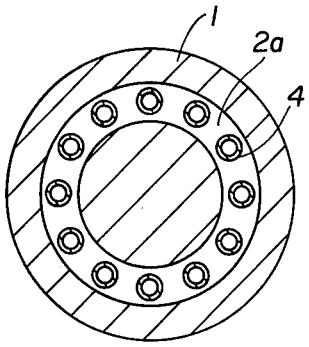
FIG. 3 is a transverse section of such a roll, showing another embodiment of the arrangement of conduits.

In the embodiment of FIG. 3, a single annular longitudinal conduit 2*a* replaces the annularly arrayed conduits 2, tubular conduits 4 being disposed in the annular conduit in the same manner as shown in FIG. 1. This modification is otherwise not distinguished from the first-described embodiment.

Figure 5:
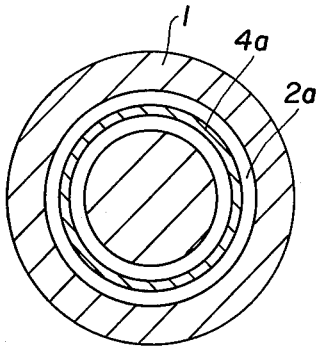
FIG. 5 is a transverse section of the roll of FIG. 4.
Figure 4:
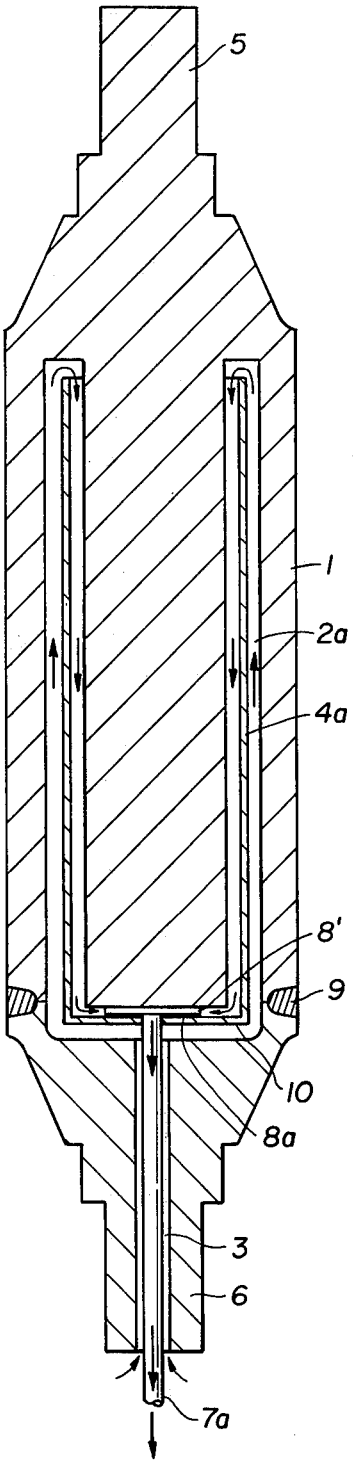
FIG. 4 is similar to FIG. 1 and shows yet another embodiment.

The embodiment of FIGS. 4 and 5 differs from that of FIG. 3 in that a single tube 4*a* is coaxially disposed in annular longitudinal conduit 2*a*. Tubular conduit 4*a* is closed off at one end by end wall 10 whereto fluid collector element 7*a* is affixed, the element 7*a* passing through the end wall. The end wall of tubular conduit 4*a* is suitably affixed to annular support 8*a* which is attached to body 1 by a perforated side wall permitting fluid flow through slots 8′ into the interior of the support and into element 7*a* which is in communication therewith. The cooling fluid circulation path is again indicated by arrows and may be reversed, as explained hereinabove.

Figure 6:
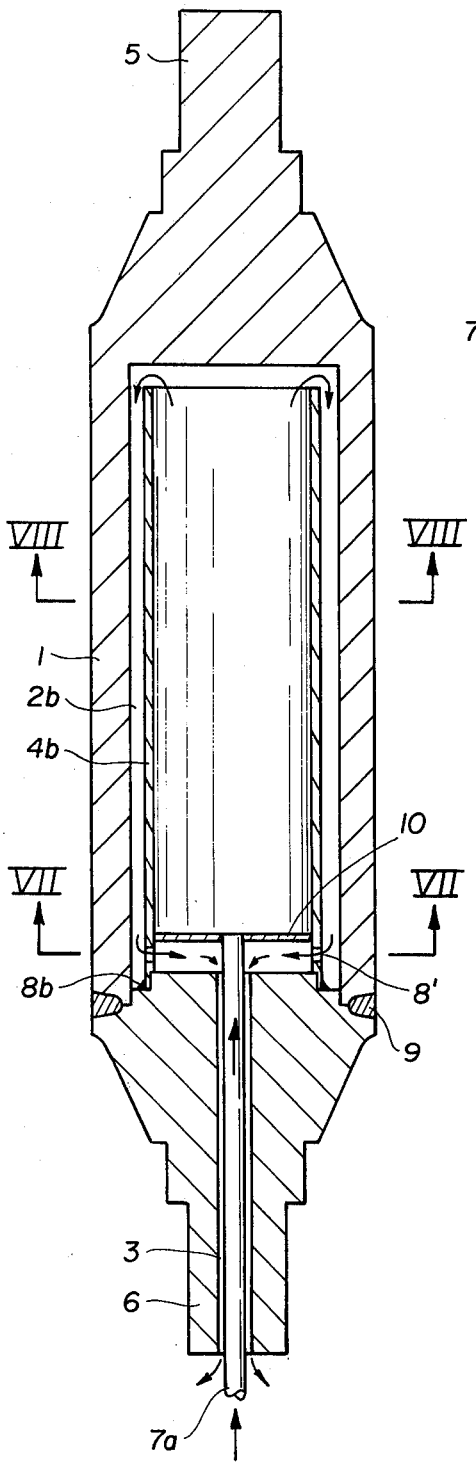
FIG. 6 is similar to FIG. 1 and shows a further embodiment.
Figure 7:
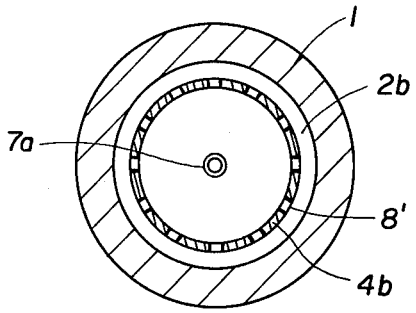
FIG. 7 is a section along line VII—VII of FIG. 6.
Figure 8:
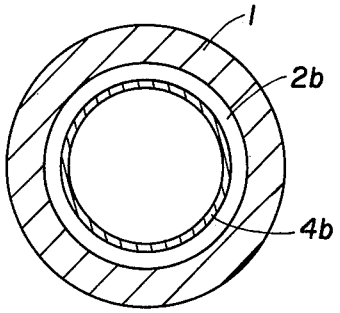
FIG. 8 is a section along line VIII—VIII of FIG. 6.

In the embodiment of FIGS. 6 to 8, cylindrical longitudinal conduit 2*b* is provided in cylindrical body 1 and tubular conduit 4*b* is coaxially disposed in the cylindrical conduit. As in the previously described embodiment, the tubular conduit has end wall 10, fluid collector element *7a* passes therethrough to communicate with the interior of tubular conduit 4*b*. Annular support 8*b* affixes the tubular conduit to trunnion 6, suitably by welding, and the support has slots 8' to permit fluid circulation in the manner indicated by the arrows.

In assembling this roll, the finished cylindrical body integral with trunnion 5 and with longitudinal conduit 2*b* and trunnion 6 carrying tubular conduit 4*b* and element *7a* affixed to the trunnion by support ring 8*b* are combined by coaxially aligning the cylindrical body and trunnion assembly, whereupon they are welded together at 9.

While the invention has been described in connection with certain preferred embodiments, it will be obvious to those skilled in the art that various modifications and changes may be made on the basis of this teaching without departing from the spirit and scope of this invention, as defined in the appended claims. The longitudinal conduits and passages seating the tubular elements in the cylindrical body and trunnion may be machined into a forged metal shape, for instance by boring or drilling. The nature of the material from which the roll is made will vary in dependence on the desired use of the roll but it will preferably be a metal casting or forged steel. Also, any useful type of cooling fluid, including water, may be used for circulating through the roll.

What is claimed is:

1. An internally cooled roll comprising (1) a cylindrical body having an axis and two coaxial trunnions, one of the trunnions constituting an integral piece with the body and the other trunnion being affixed thereto, the body defining in the interior thereof (2) a longitudinal conduit extending in the direction of the axis for circulating a cooling fluid therethrough, the conduit being closed to an end on the side of the one trunnion, (2) a tubular conduit disposed in the longitudinal conduit and extending over most of the length of the longitudinal conduit whereby the tubular conduit is surrounded by the longitudinal conduit, and (3) means for supplying the cooling fluid to one of the conduits and removing the fluid from the other conduit, the fluid flowing through the conduits in opposite directions, said means including (a) a fluid collector element connected to the tubular conduit and passing through the other trunnion.

2. The internally cooled roll of claim 1, wherein the other trunnion defines a fluid passage, the fluid collector element is disposed in the passage, and the passage and fluid collector element constitute said means.

3. The internally cooled roll of claim 1, wherein the body defines a plurality of said longitudinal conduits, the longitudinal conduits being cylindrical and distributed evenly about the axis in an annular array, and a respective one of the tubular conduits being disposed in each of the longitudinal conduits.

4. The internally cooled roll of claim 1, wherein the longitudinal conduit is an annular conduit about the axis of the body, and a plurality of said tubular conduits are disposed in the annular conduit and are evenly distributed therein in an annular array.

5. The internally cooled roll of claim 1, wherein the longitudinal conduit is an annular conduit about the axis of the body, and the tubular conduit is coaxially disposed in the annular conduit.

6. The internally cooled roll of claim 1, wherein the longitudinal conduit is a cylindrical conduit coaxial with the body, and the tubular conduit is coaxially disposed in the cylindrical conduit.

7. The internally cooled roll of claim 1, wherein the other trunnion is welded to the cylindrical roll body.

8. The internally cooled roll of claim 1, wherein said body is a casting.

9. The internally cooled roll of claim 1, wherein said body is a forging shaped by machining.

* * * * *